US010018165B1

(12) United States Patent
Torgerud et al.

(10) Patent No.: US 10,018,165 B1
(45) Date of Patent: Jul. 10, 2018

(54) FUEL LINES HAVING MULTIPLE LAYERS AND ASSEMBLIES THEREOF

(71) Applicant: Brunswick Corporation, Lake Forest, IL (US)

(72) Inventors: Michael A. Torgerud, Mt. Calvary, WI (US); Pankaj Ankush Jagadale, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 180 days.

(21) Appl. No.: 14/956,938

(22) Filed: Dec. 2, 2015

(51) Int. Cl.
*F02M 37/00* (2006.01)

(52) U.S. Cl.
CPC ..... *F02M 37/0017* (2013.01)

(58) Field of Classification Search
CPC ..... B32B 1/08; B32B 27/08; B32B 27/34; B32B 27/30; B32B 27/32; B32B 25/08; B32B 27/20; F16L 2011/047; F16L 11/045; F16L 9/121; F16L 9/123; F16L 11/127; Y10S 138/07; Y10S 138/03; Y10T 428/1393
See application file for complete search history.

(56) References Cited

U.S. PATENT DOCUMENTS 5,076,329 A * 12/1991 Brunnhofer ..... F02M 37/0017 138/137
5,611,373 A * 3/1997 Ashcraft ..... F16L 9/18 138/113
5,628,532 A 5/1997 Ashcraft
6,244,917 B1 6/2001 Hartke et al.
6,896,005 B2 5/2005 Noone et al.
7,112,110 B1 9/2006 Kollmann
7,476,135 B2 1/2009 Caldwell et al.
7,579,058 B2 8/2009 Dowe et al.
8,739,836 B2 6/2014 Oyaizu et al.
8,789,719 B2 7/2014 Whelan et al.
8,833,346 B2 9/2014 Whelan et al.
2004/0142135 A1* 7/2004 Verschuere ..... B32B 1/08 428/36.91
2006/0099368 A1* 5/2006 Park ..... B32B 1/08 428/36.91
2006/0131884 A1* 6/2006 Inoue ..... F02M 37/0017 285/420
2006/0134360 A1* 6/2006 Inoue ..... B32B 1/08 428/36.91

(Continued)

OTHER PUBLICATIONS

Stanley Weitz et al., Testing the Electrostatic (ESD) Parameters of Thermoformed Conductive and Low Static Dissipative Materials fro Applicaitons Including Automotive Fuel Systems (Proposed Revisions to SAE J1645), ETS—Electro-Tech Systems, Inc. www.electrotechsystems.com, website visited Nov. 25, 2015.

*Primary Examiner* — Sizo Vilakazi
(74) *Attorney, Agent, or Firm* — Andrus Intellectual Property Law, LLP

(57) ABSTRACT

A layered fuel line for an engine fuel system includes a plurality of layers. The fuel line includes an inner layer and an outer layer material having a relatively high temperature resistance. The fuel line can include a barrier layer and intermediate layers. The fuel line can be included in a fuel line assembly that includes fittings capable of connecting to engine fuel system components. Silicone boots wrapping the fittings can increase the high temperature resistance of the assembly.

20 Claims, 4 Drawing Sheets

(56) References Cited

U.S. PATENT DOCUMENTS

| | | | | |
|---|---|---|---|---|
| 2007/0044906 | A1* | 3/2007 | Park | B29C 47/0023 156/272.2 |
| 2007/0045967 | A1* | 3/2007 | Park | F16J 15/104 277/534 |
| 2007/0048476 | A1* | 3/2007 | Park | B29C 47/0004 428/36.91 |
| 2008/0014397 | A1* | 1/2008 | Manai | B32B 1/08 428/36.9 |
| 2009/0098325 | A1* | 4/2009 | Uchida | B32B 1/08 428/36.91 |
| 2013/0273289 | A1* | 10/2013 | Luo | F16L 11/04 428/36.91 |
| 2013/0273290 | A1* | 10/2013 | Luo | F16L 9/147 428/36.92 |

* cited by examiner

FUEL LINES HAVING MULTIPLE LAYERS AND ASSEMBLIES THEREOF

FIELD

The present disclosure generally relates to fuel lines and assemblies including the fuel lines for engine fuel systems. In particular, the present disclosure relates to fuel lines having multiple layers and assemblies thereof.

BACKGROUND

Conventional fuel lines and assemblies that include fuel lines for engine fuel systems are known in the art. The following U.S. patents and patent applications are hereby incorporated by reference in their entirety.

U.S. Pat. No. 7,112,110 discloses a fuel system for a marine propulsion system having a container, in addition to the fuel tank of the marine vessel, which contains fuel pumps, a filter, a pressure regulator, and possibly a fuel cooler. Some or all of these components can be submerged under the surface of a pool of liquid fuel within the container. The container is displaced physically from the fuel tank of a marine vessel.

U.S. Pat. No. 8,833,346 discloses an apparatus and methods for mounting fuel delivery system components to fuel tanks. An example fuel tank includes a housing having a cavity to store a liquid fuel and a boss integrally formed with and protruding from a surface of the housing to receive a fuel delivery system component. The boss receives a threaded fastener to couple the fuel delivery system component to the surface of the fuel tank.

U.S. Pat. No. 8,789,719 discloses an apparatus and methods to permanently attach fuel delivery system components to fuel tanks. The apparatus includes an insert material integrally formed with at least a portion of the fuel tank. The insert material includes a first layer material having a low permeation characteristic and a second layer material adjacent the first layer material having a relatively lower melting point than a melting point of the first layer material to enable permanent attachment of a coupling apparatus to a surface of the fuel tank by melting at least a portion of the second layer material.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure relates to fuel lines and assemblies that include fuel lines for engine fuel systems. The disclosed fuel lines include multiple layers of different materials and may be referred to as layered fuel lines. In certain examples, the disclosed fuel lines may include an inner layer and an outer layer in which the outer layer may be coupled directly or indirectly to the inner layer. The inner layer may include an electrostatic discharge material and the outer layer may include a material having a relatively high temperature resistance.

The present disclosure relates to fuel lines included in assemblies for engine fuel systems. In certain examples, the disclosed assemblies include a fuel line having a pair of ends, a fitting coupled to each end, and a boot comprising a silicone wrapped around each fitting. The fuel line of the assemblies may include multiple layers as described herein.

Various other features, objects and advantages of the invention will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

In the present disclosure, certain terms have been used for brevity, clarity, and understanding. No unnecessary limitations are to be inferred therefrom beyond the requirement of the prior art because such terms are used for descriptive purposes and are intended to be broadly construed. The disclosed subject matter further may be described utilizing terms as defined below.

Unless otherwise specified or indicated by context, the terms "a", "an", and "the" mean "one or more." For example, the term "a layer" should be interpreted to mean "one or more layers." In addition, the term "plurality" should be interpreted to mean two or more layers. For example, the term "a plurality of layers" should be interpreted to mean two or more layers.

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising." The terms "comprise" and "comprising" should be interpreted as being "open" transitional terms that permit the inclusion of additional components further to those components recited in the claims. The terms "consist" and "consisting of" should be interpreted as being "closed" transitional terms that do not permit the inclusion of additional components other than the components recited in the claims. The term "consisting essentially of" should be interpreted to be partially closed and allowing the inclusion only of additional components that do not fundamentally alter the nature of the claimed subject matter.

Figure 1:
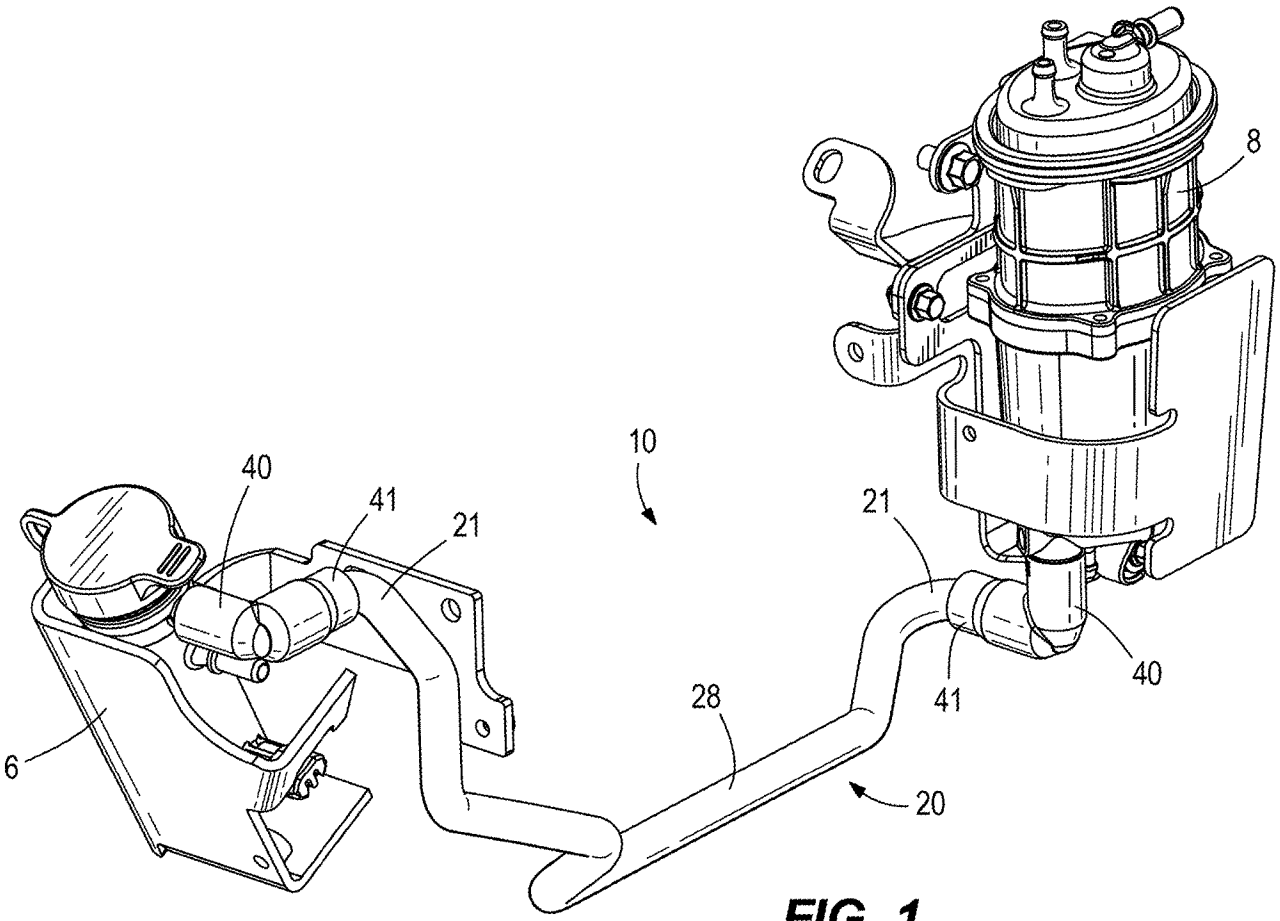
FIG. 1 is a perspective view of a fuel line assembly connecting a fuel module and a fuel filter.
Figure 2:
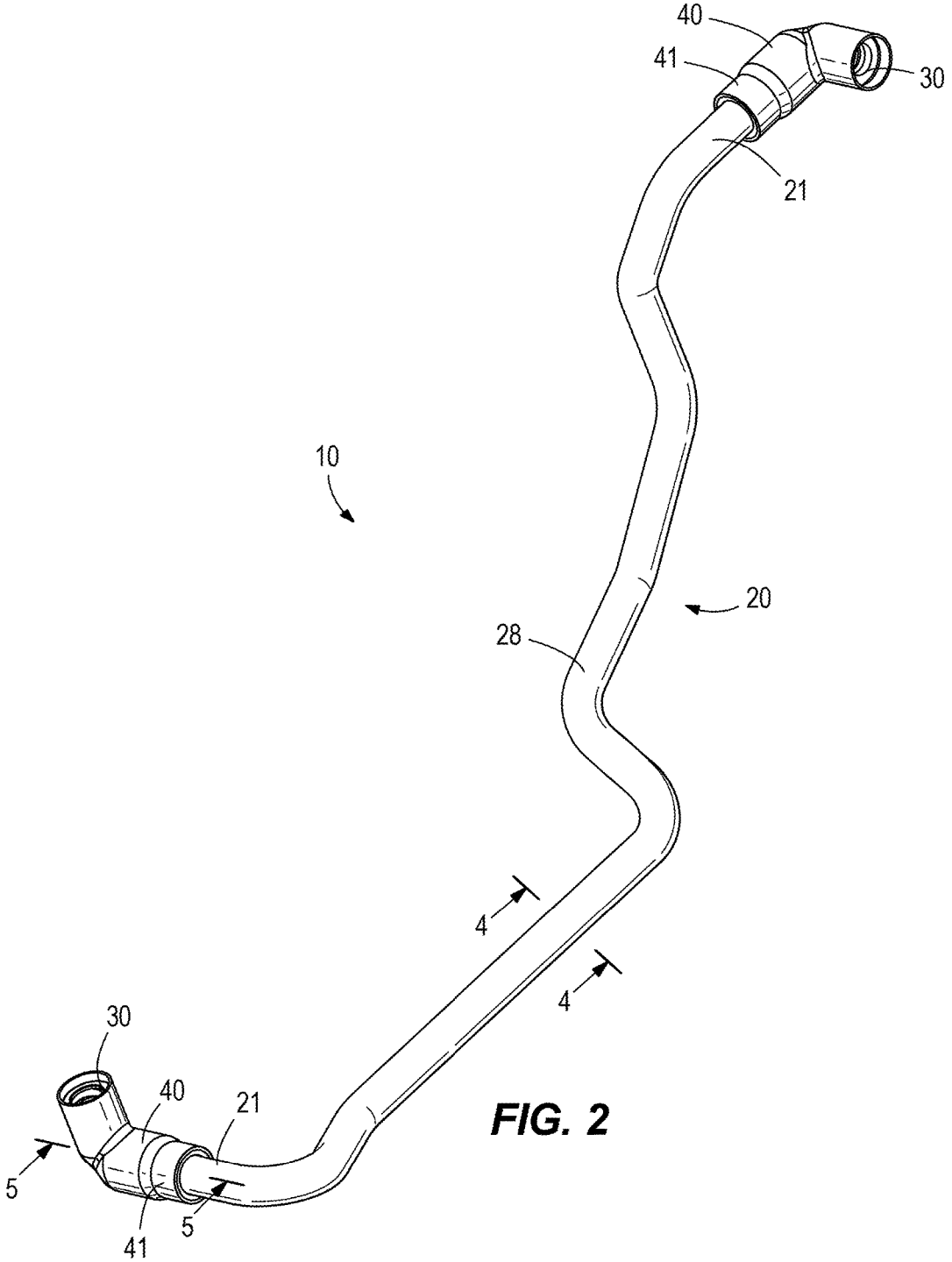
FIG. 2 is the fuel line assembly of FIG. 1.
Figure 3:
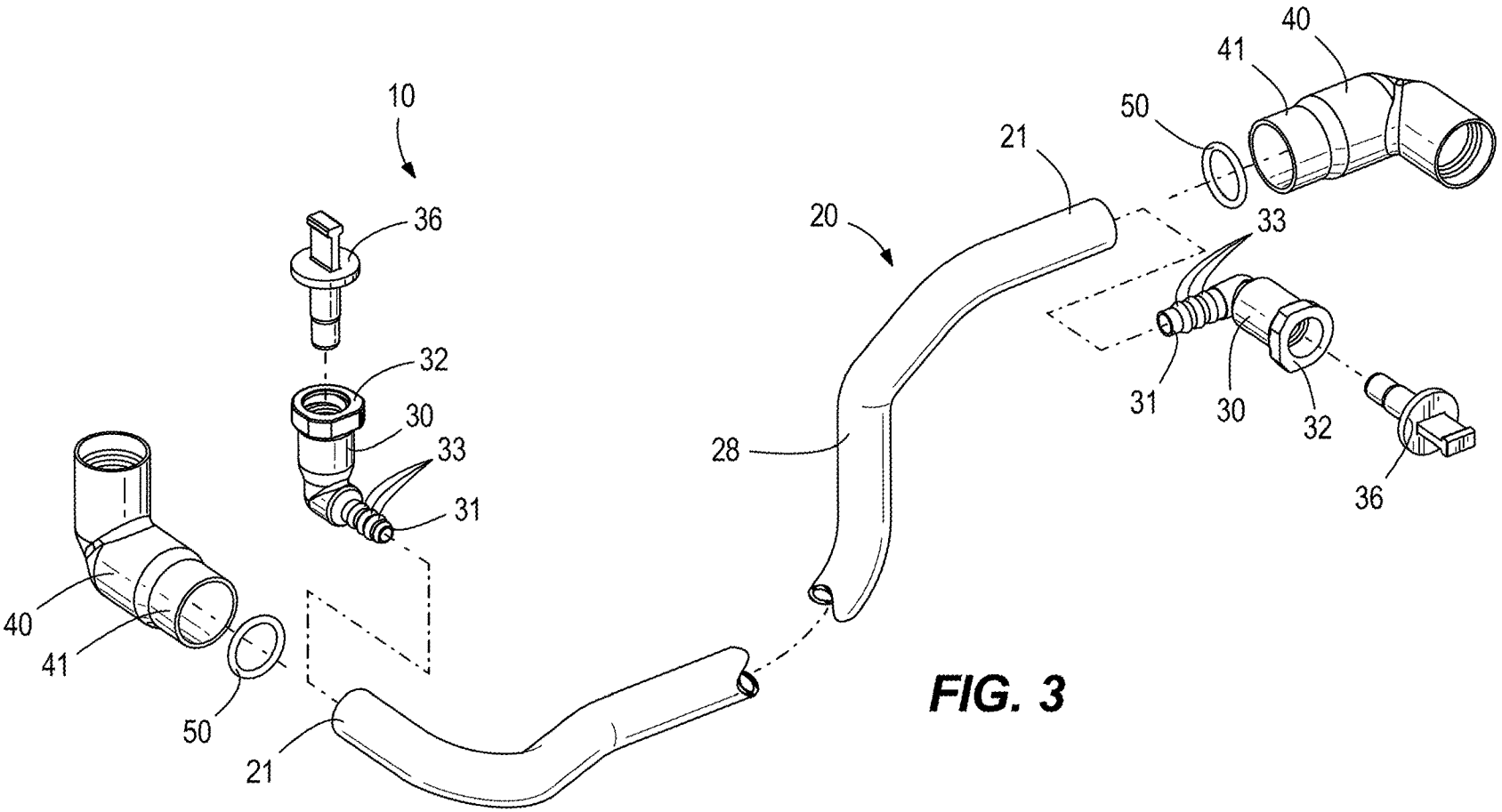
FIG. 3 is an exploded view of the fuel line assembly of FIG. 2.
Figure 4:
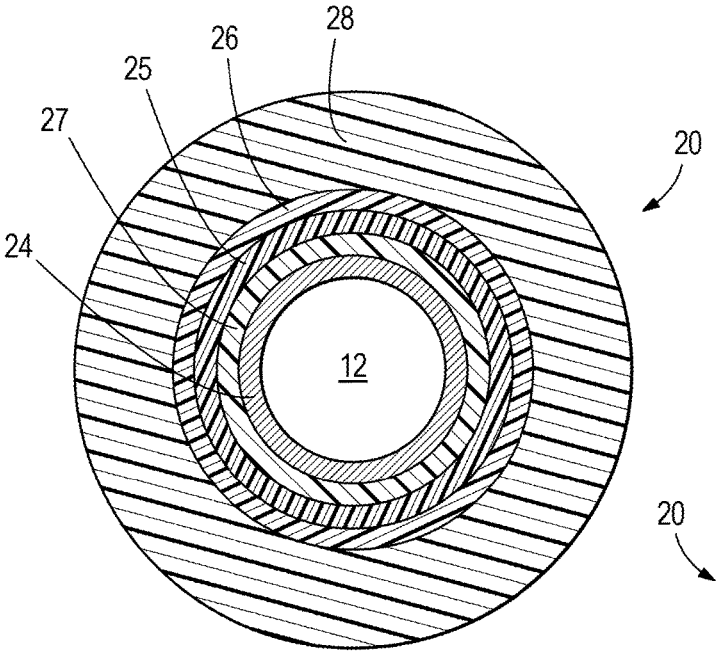
FIG. 4 is a view of section 4-4 of FIG. 2.
Figure 5:
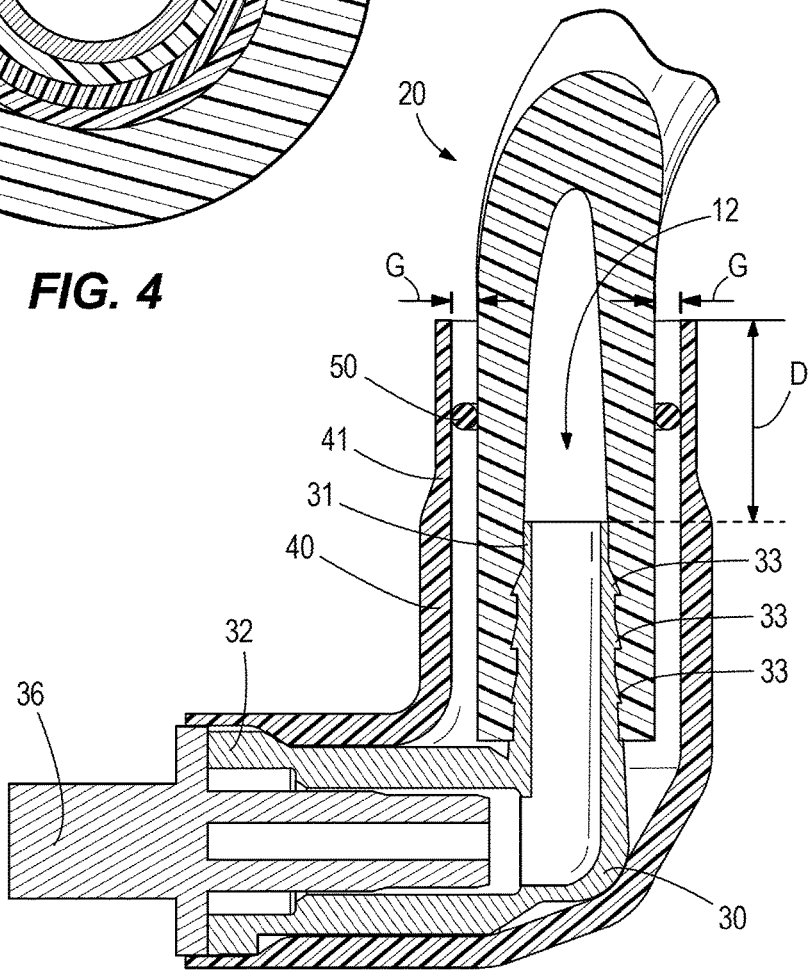
FIG. 5 is a view of section 5-5 of FIG. 2.

FIGS. 1-5 depict a fuel line assembly 10 for engine fuel systems, specifically for connecting engine fuel system components. In one example, the fuel line assembly 10 connects a fuel filter 6 to a fuel module 8. Conventional fuel line assemblies include a rubber hose with a pair of metallic quick-connects and a loose fitting fiberglass sleeve.

The fuel line assembly 10 of the present disclosure includes a fuel line 20 having a plurality of layers, described herein. The fuel line 20 can be formed by a coextrusion process such that the layers are extruded as a unitary fuel line 20. The fuel line 20 is semi-rigid and can vary in shape and length.

As illustrated, the fuel line 20 includes an inner layer 24 and outer layer 28. The fuel line 20 has a pair of ends 21 and defines a passageway 12 (see FIG. 4). The inner layer 24 comprises an electrostatic discharge material, for example, a material having a surface resistivity greater than about 10^4 ohm/cm^2 and less than about 10^11 ohm/cm^2. Surface resistivity may be measured using methods known in the art. (See, e.g., Stanley Weitz, "Tesing the Electrostatic (ESD) Parameters of Thermoformed Conductive and Low Static Dissipative Materials for Applications Including Automative Fuel Systmes, ETS—Elector-Tech Systems, Inc.). Suitable electrostatic discharge materials may include polymers, for example, polymers that are chemically resistant to petroleum. Suitable polymers that are chemically resistant to petroleum may include, but are not limited to polyamides, and in some examples the polymers are polyamides such as nylons. Suitable nylons may include but are not limited to nylon 6; nylon 6,6; nylon 12; and alloys thereof. Nylons may be utilized to resist electrostatic discharge and/or shed static electricity that can build up in the fuel line 20 as fluid flows through the passageway 12.

The outer layer 28 includes a material having a relatively high temperature resistance. Preferably, the material having a relatively high temperature resistance has a high service temperature of at least about 80, 90, or 100 degrees Celsius (e.g., a material having a service temperature range of about −60 to about 105 degrees Celsius). In some embodiments, the outer layer 28 includes a material that comprises an elastomeric material, a thermoplastic material, or a combination thereof. Preferably, the material having a relatively high temperature resistance has properties of vulcanized rubber and processing properties of thermoplastics.

Suitable elastomeric materials of the outer layer 28 may include, but are not limited to, natural or synthetic rubbers (e.g., thermoset rubbers), including rubbers formed by polymerizing monomers selected from ethylene, propylene, dienes (e.g., butadienes such as 1,3-butadiene, isoprenes such as 2-methyl-1,3-butadiene, chloropenes such as 2-chloro-1,3-butadiene, and isobutylene), and styrene. In some examples, the elastomeric is a co-polymer (e.g., a co-polymer of ethylene and propylene monomer) or a ter-polymer (e.g., a ter-polymer of ethylene, propylene, and a diene monomer). Optionally, the ethylene monomer content of the co-polymer or ter-polymer is about 45% to about 85%.

Suitable thermoplastic materials of the outer layer 28 may include, but are not limited to thermoplastic polymers. Thermoplastic polymers may include, but are not limited to, polypropylene, polybenzimidazole, polycarbonate, polyether sulfone, polyetherether ketone, polyetherimide, polyphenylene oxide, polyphenylene sulfide, polystyrene, polyvinyl chloride, Teflon, and mixtures thereof.

In some embodiments, the material of the outer layer 28 having a relatively high temperature resistance is a mixture of an elastomeric material and a thermoplastic material. The mixture may comprise an elastomeric material (e.g., a rubber) encapsulated in a thermoplastic material (e.g., a thermoplastic polymer). Preferably, the mixture comprises a ter-polymer of ethylene, propylene, and a diene monomer encapsulated in polypropylene. Suitable mixtures may include thermoplastic vulcanizates (TPV), such as the mixture sold under the trademark SANTOPRENE™.

The thickness of the outer layer 28 can vary and may be dependent on the size of the passageway 12. For example, the outer layer 28 can have a thickness of 1.0, 2.0, 3.0, 5.0, 10.0, or 15.0 mm. Through research and experimentation, the present inventors have discovered that is it advantageous for the thickness of the outer layer 28 to be greater than 3.0 mm and preferably 5.0 mm.

The fuel line 20 can include a plurality of intermediate layers between the inner layer 24 and the outer layer 28. (see FIG. 4). In one non-limiting example, the fuel line 20 includes a barrier layer 25, a first intermediate layer 26, and a second intermediate layer 27. The barrier layer 25 and intermediate layers 26, 27 may be co-extruded with and between the inner layer 24 and the outer layer 28.

The barrier layer 25 may comprise a thermoplastic material. The barrier layer 25 is concentrically coupled between the inner layer 24 and outer layer 28. In one example, the barrier layer 25 is a thermoplastic fluoropolymer such as polyvinylidene difluoride (PVDF). The inclusion of the barrier layer 25 with the fuel line 20 may satisfy fuel line permeation performance or air quality standards or requirements set by commercial and/or government agencies, such as the Air Resource Board and United States Environmental Protection Agency.

The first intermediate layer 26 comprises a polymer and is concentrically coupled between the barrier layer 25 and the outer layer 28. For example, the first intermediate layer 26 is coupled between the barrier layer 25 and the outer layer 28. (see FIG. 4). The first intermediate layer 26 increases the durability of the fuel line 20 and may comprise a polyamide such as nylon. In one non-limiting example, the first intermediate layer 26 is a nylon selected from a group of nylon 6; nylon 6,6; nylon 12; and alloys thereof.

The second intermediate layer 27 may comprise a polymer and is concentrically coupled between the inner layer 24 and the outer layer 28. For example, the second intermediate layer 27 is coupled between the inner layer 25 and the barrier layer 27. (see FIG. 4). The second intermediate layer 27 increases the durability of the fuel line 20 may comprise a polyamide such as nylon. In one non-limiting example, the second intermediate layer 27 is a nylon selected from a group of nylon 6; nylon 6,6; nylon 12; and alloys thereof. In an exemplary embodiment, the fuel line 20 comprises a 0.1 mm nylon inner layer 24, a 0.3 mm nylon second intermediate layer 27, a 0.2 mm PVDF barrier layer 25, a 0.4 mm nylon first intermediate layer 26, and a 5.0 mm thermoplastic vulcanizate (TPV) outer layer 28.

The fuel line assembly 10 includes a fitting 30 coupled to each fuel line end 21. The fittings 30 include a first end 31 for coupling the fitting 30 to the fuel line 20 and a second end 32 configured to connect to components of the engine fuel system, such as the fuel filter 6 and fuel module 8. (see FIG. 1). The first end 31 has concentric barbs 33 configured to secure the fittings 30 to the fuel line 20. In operation, the fuel line end 21 is forced over the barbs 33 to mechanically couple the fuel line 20 to the fitting 30 and prevent the fuel line 20 from disconnecting from the fitting 30. (see FIG. 5). The first end 31 can be tapered. The second end 32 can include a removable dust cap 36 configured to prevent particles from the entering the fuel line assembly 10 before the fuel line assembly 10 is connected to the engine fuel system. (see FIG. 3). The fittings 30 comprise a polyamide, and in some examples the polyamide of the fitting 30 is the same polyamide of the inner layer 24. The polyamide of the fitting 30 is a nylon selected from a group of nylon 6, nylon 6,6, nylon 12, and alloys thereof.

The fuel line assembly 10 can also include boots 40 capable of increasing the high temperature resistance of the fuel line assembly. (see FIGS. 3 and 5). The boots 40 are positioned around the fittings 30 and wrap or encase each fitting 30. The boots 40 are sized to be slightly smaller than the fittings 30 such that once the boots 40 are stretched over the fittings 30, elastic properties of the boots 40 cause the boots 40 to fictionally engage with the fittings 30. The boots 40 can extend away from the fittings 30 to overlap or cover a portion of the fuel line 20. (see FIG. 5). For example, the boot 40 overlaps the fuel line by a distance D. (see FIG. 5). In one non-limiting example, the boots 40 overlaps 50 mm of the fuel line 20 at each end 21. The boots 40 can comprise a silicone. An O-ring 50 is concentrically coupled to the fuel line 20 and positioned between the fuel line 20 and the boot 40 such that the O-ring 50 fills a gap G between the fuel line 20 and the boot 40. (see FIG. 5).

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel line assembly for an engine system comprising:

a fuel line having opposing ends, an inner layer that defines a passageway through which fuel is conveyed, and an opposite, outer layer;

wherein the inner layer comprises a nylon selected from a group of nylon 6, nylon 6,6, nylon 12, and alloys thereof;

fittings having first ends that couple to the ends of the fuel line and engage with the inner layer of the fuel line and opposite, second ends that couple to the engine system, wherein the fittings comprise a nylon selected from a group of nylon 6, nylon 6,6, nylon 12, and alloys thereof; and boots wrapped around the fittings such that the boots extend along the entirety of the fittings and extend away from the first ends such that the boots overlap the fuel line, wherein the boots are configured to increase temperature resistance of the fuel line assembly, and wherein the boots comprise a silicone.

2. The fuel line assembly of claim 1, wherein the outer layer comprises a dynamically vulcanized alloy comprising a ter-polymer of ethylene propylene diene monomers encapsulated in polypropylene such that the outer layer has a relatively high temperature resistance.

3. The fuel line assembly of claim 2, wherein the fuel line has a barrier layer positioned between the inner layer and the outer layer, wherein the barrier layer increases fuel permeation performance of the fuel line, and wherein the barrier layer comprises a thermoplastic polymer.

4. The fuel line assembly of claim 2, wherein gaps are defined between the outer layer of the fuel line and the boots; and further comprising O-rings that are concentrically coupled to the outer layer of the fuel line and positioned in the gaps.

5. The fuel line assembly of claim 4, wherein the boots are configured to elastically deform such that the boots can be stretched over the fittings and frictionally engage the fittings.

6. The fuel line assembly of claim 2, wherein the boots extend away from the second ends of the fittings.

7. The fuel line assembly of claim 2, wherein the boots extend 50.0 millimeters away from the first ends of the fittings.

8. A fuel line assembly for an engine system comprising:

a fuel line having a pair of ends, an inner layer that defines a passageway through which fuel is conveyed, and an opposite, outer layer, wherein the inner layer comprises an electrostatic discharge material;

fittings having first ends that couple the ends of the fuel line and engage with the inner layer of the fuel line and opposite, second ends that couple to the engine system, wherein the fittings comprise a nylon selected from a group of nylon 6, nylon 6,6, nylon 12, and alloys thereof; and boots wrapped around the fittings such that the boots extend along the entirety of the fittings and extend away from the first ends of the fittings such the boots overlap the fuel line, wherein the boots are configured to increase temperature resistance of the fuel line assembly, and wherein the boots comprise silicone.

9. The fuel assembly of claim 8, wherein the electrostatic discharge material comprises a polyamide.

10. The fuel assembly of claim 9, wherein the polyamide comprises a ter-polymer of ethylene propylene diene monomers encapsulated in polypropylene.

11. The fuel line assembly of claim 8, wherein the outer layer comprises a dynamically vulcanized alloy comprising a ter-polymer of ethylene propylene diene monomers encapsulated in polypropylene such that the outer layer has a relatively high temperature resistance.

12. The fuel line assembly of claim 11, wherein the fuel line has a barrier layer positioned between the inner layer and the outer layer, wherein the barrier layer increases fuel permeation performance of the fuel line.

13. The fuel line assembly of claim 12, wherein the barrier layer comprises a thermoplastic polymer.

14. The fuel line assembly of claim 13, wherein the barrier layer comprises a thermoplastic fluoropolymer.

15. The fuel line assembly of claim 14, wherein the barrier layer comprises polyvinylidene fluoride.

16. The fuel line assembly of claim 15, wherein gaps are defined between the outer layer of the fuel line and the boots; and further comprising O-rings that are concentrically coupled to the outer layer of the fuel line and positioned in the gaps.

17. The fuel line assembly of claim 16, wherein the boots are configured to elastically deform such that the boots can be stretched over the fittings and frictionally engage the fittings.

18. A fuel line assembly for an engine system comprising:

a fuel line having a pair of ends, an inner layer that defines a passageway through which fuel is conveyed, and an opposite, outer layer, wherein the inner layer comprises an electrostatic discharge material;

fittings having first ends that couple the ends of the fuel line and engage with the inner layer of the fuel line and opposite, second ends that couple to the engine system; and boots wrapped around the fittings such that the boots extend along the entirety of the fittings and extend away from the first ends of the fittings such the boots overlap the fuel line, wherein the boots are configured to increase temperature resistance of the fuel line assembly and define gaps between the outer layer of the fuel line and the boots, and wherein the boots comprise silicone; and an O-ring concentrically coupled to the outer layer of the fuel line and positioned in one of the gaps.

19. The fuel line assembly according to claim 18, wherein the electrostatic discharge material comprises a nylon selected from a group of nylon 6, nylon 6,6, nylon 12, and alloys thereof;

wherein the fittings comprise a nylon selected from a group of nylon 6; nylon 6,6; nylon 12; and alloys thereof; and wherein the outer layer comprises a dynamically vulcanized alloy comprising a ter-polymer of ethylene propylene diene monomers encapsulated in polypropylene such that the outer layer has a relatively high temperature resistance.

20. The fuel line assembly of claim 19, wherein the fuel line has a barrier layer positioned between the inner layer and the outer layer, wherein the barrier layer increases fuel permeation performance of the fuel line, and wherein the barrier layer comprises a thermoplastic polymer.

* * * * *